US007308891B2

(12) United States Patent
Graf

(10) Patent No.: US 7,308,891 B2
(45) Date of Patent: Dec. 18, 2007

(54) PRODUCTS AND PROCESSES FOR ARCHERY AND FIREARM SIGHTS

(75) Inventor: Stephen Charles Graf, Cedar Grove, NC (US)

(73) Assignee: SOP Services, Inc., Las Vegas, NV (US)

( * ) Notice: Subject to any disclaimer, the term of this patent is extended or adjusted under 35 U.S.C. 154(b) by 95 days.

(21) Appl. No.: 10/985,403

(22) Filed: Nov. 11, 2004

(65) Prior Publication Data

US 2006/0096150 A1 May 11, 2006

(51) Int. Cl.
*F41G 1/467* (2006.01)

(52) U.S. Cl. ..... 124/87; 42/113; 42/130; 42/132; 33/265

(58) Field of Classification Search ..... 42/113, 42/125, 130–132, 123; 124/87; 33/265
See application file for complete search history.

(56) References Cited

U.S. PATENT DOCUMENTS

| | | | | | |
|---|---|---|---|---|---|
| 453,828 | A | | 6/1891 | Carver | |
| 837,563 | A | | 12/1906 | Hartmann | |
| 1,174,063 | A | | 3/1916 | Frank | |
| 1,225,592 | A | | 5/1917 | Del Borgo | |
| 1,989,863 | A | | 2/1935 | Humeston | |
| 2,161,303 | A | * | 6/1939 | Loomis | 42/130 |
| 2,553,309 | A | * | 5/1951 | Gabrielson | 33/329 |
| 2,645,017 | A | | 7/1953 | Haase | |
| 2,706,335 | A | | 4/1955 | Munsey | |
| 2,770,041 | A | * | 11/1956 | Boll | 42/137 |
| 2,932,896 | A | | 4/1960 | Hicinbothem | |
| 2,941,296 | A | | 6/1960 | Grandt | |
| 4,130,958 | A | | 12/1978 | Gutridge | |
| 4,479,307 | A | | 10/1984 | Pomeranz | |
| 4,519,674 | A | * | 5/1985 | Buckley et al. | 359/514 |
| 4,525,037 | A | * | 6/1985 | Metabi | 359/740 |
| 4,532,717 | A | * | 8/1985 | Watson et al. | 33/265 |
| 4,679,344 | A | | 7/1987 | Jolly | |
| 4,745,698 | A | | 5/1988 | Schwulst | |
| 4,833,786 | A | * | 5/1989 | Shores, Sr. | 33/265 |
| 4,850,113 | A | | 7/1989 | Doll | |
| 4,910,874 | A | | 3/1990 | Busch | |
| 4,993,158 | A | | 2/1991 | Santiago | |
| 5,151,753 | A | * | 9/1992 | Whitman, III | 356/142 |

(Continued)

OTHER PUBLICATIONS

SURE-LOC Archery Products, Installation and Adjustment Instructions for Lethal Weapon, 2003.

(Continued)

*Primary Examiner*—Stephen M. Johnson
(74) *Attorney, Agent, or Firm*—Woodard, Emhardt, Moriarty, McNett & Henry LLP

(57) ABSTRACT

Archery and firearm sight products and processes are disclosed. In an exemplary embodiment an apparatus may comprise a sight ring and a shaft. The sight ring may comprise a proximal end, a distal end, and a track. The track may comprise a major axis disposed substantially parallel with a vertical axis of the sight ring. The shaft may comprise a first end, a second end opposite the first end, and a body disposed between the first and second ends of the shaft. The first end of the shaft may be removably coupled with the sight ring and may be adapted to be displaced along the track of the sight ring.

35 Claims, 7 Drawing Sheets

U.S. PATENT DOCUMENTS

| | | | | |
|---|---|---|---|---|
| 5,155,556 | A * | 10/1992 | Foanio | 356/397 |
| 5,519,941 | A | 5/1996 | Yusko | |
| 5,560,113 | A | 10/1996 | Simo et al. | |
| 5,638,604 | A | 6/1997 | Lorocco | |
| 5,924,234 | A | 7/1999 | Bindon et al. | |
| RE36,266 | E | 8/1999 | Gibbs | |
| 5,933,972 | A | 8/1999 | Springer, Jr. | |
| 6,000,141 | A | 12/1999 | Afshari | |
| 6,016,608 | A | 1/2000 | Lorocco | |
| 6,418,633 | B1 | 7/2002 | Rager | |
| 6,477,778 | B1 | 11/2002 | Lorocco | |
| 6,508,005 | B2 | 1/2003 | Springer | |
| 6,513,276 | B2 | 2/2003 | Mendoza-Orozco | |
| 6,560,884 | B1 | 5/2003 | Afshari | |
| 6,564,462 | B1 | 5/2003 | Henry | |
| 6,581,317 | B1 | 6/2003 | Slates | |
| 6,601,308 | B2 | 8/2003 | Khoshnood | |
| 6,604,315 | B1 | 8/2003 | Smith et al. | |
| 6,609,306 | B2 * | 8/2003 | Johnson et al. | 33/265 |
| 6,634,110 | B2 * | 10/2003 | Johnson | 33/265 |
| 6,725,854 | B1 | 4/2004 | Afshari | |
| 6,802,131 | B1 * | 10/2004 | Scholz et al. | 33/293 |
| 7,086,161 | B2 * | 8/2006 | Ellig et al. | 33/265 |
| 2002/0066220 | A1 | 6/2002 | Malley | |
| 2003/0233757 | A1 * | 12/2003 | Nordberg | 33/265 |
| 2004/0088872 | A1 | 5/2004 | Deien | |

OTHER PUBLICATIONS

Bowan's Archery Catalog, "Archer's Choice Sights," web site at http://www.thebowman.com, as available via the Internet and printed Feb. 10, 2005.
Bowan's Archery Catalog, "Cobra Sights," web site at http://www.thebowman.com, as available via the Internet and printed Feb. 10, 2005.
Bowan's Archery Catalog, "Copper John Sights," web site at http://www.thebowman.com, as available via the Internet and printed Feb. 10, 2005.
Bowan's Archery Catalog, "Extreme Sights," web site at http://www.thebowman.com, as available via the Internet and printed Feb. 10, 2005.
Bowan's Archery Catalog, "GWS Sights," web site at http://www.thebowman.com, as available via the Internet and printed Feb. 10, 2005.
Bowan's Archery Catalog, "HHA Sights," web site at http://www.thebowman.com, as available via the Internet and printed Feb. 10, 2005.
Bowan's Archery Catalog, "HHA Sights," web site at http://www.thebowman.com, as available via the Internet and printed Feb. 10, 2005.
Bowan's Archery Catalog, "HTM Sights," web site at http://www.thebowman.com, as available via the Internet and printed Feb. 10, 2005.
Bowan's Archery Catalog, "Impact Archery Sights," web site at http://www.thebowman.com, as available via the Internet and printed Feb. 10, 2005.
Bowan's Archery Catalog, "Montana Black Gold Sights," web site at http://www.thebowman.com, as available via the Internet and printed Feb. 10, 2005.
Bowan's Archery Catalog, "Predator IV Sights," web site at http://www.thebowman.com, as available via the Internet and printed Feb. 10, 2005.
Bowan's Archery Catalog, "PSE Sights," web site at http://www.thebowman.com, as available via the Internet and printed Feb. 10, 2005.
Bowan's Archery Catalog, "Savage Sights," web site at http://www.thebowman.com, as available via the Internet and printed Feb. 10, 2005.
Bowan's Archery Catalog, "Sight Master Sights," web site at http://www.thebowman.com, as available via the Internet and printed Feb. 10, 2005.
Bowan's Archery Catalog, "Spot Hogg Sights," web site at http://www.thebowman.com, as available and printed Feb. 10, 2005.
Bowan's Archery Catalog, "Sure Loc Hunting Sights," web site at http://www.thebowman.com, as available via the Internet and printed Feb. 10, 2005.
Bowan's Archery Catalog, "Timberline Sights," web site at http://www.thebowman.com, as available via the Internet and printed Feb. 10, 2005.
Bowan's Archery Catalog, "Toxonics Hunting Sights," web site at http://www.thebowman.com, as available via the Internet and printed Feb. 10, 2005.
Bowan's Archery Catalog, "Trophy Ridge Sights," web site at http://www.thebowman.com, as available via the Internet and printed Feb. 10, 2005.
Bowan's Archery Catalog, "Trophy Taker Sights," web site at http://www.thebowman.com, as available via the Internet and printed Feb. 10, 2005.
Bowan's Archery Catalog, "TruGlo Sights," web site at http://www.thebowman.com, as available via the Internet and printed Feb. 10, 2005.
Bowan's Archery Catalog, "Vital Bow Gear Sights," web site at http://www.thebowman.com, as available via the Internet and printed Feb. 10, 2005.
ATA (Archery Trade Association), Salt Lake City, Utah, "2004 ATA Archery Trade Show Guide", ATA Trade Show, Jan. 22-25, 2004, Indianapolis, Indiana, pp. 20, 39, 49, 51, 60, 82, 88, 99-100.
Browning Archery, Tucson, Arizona, "2004 Product Catalog", p. 14.
Concept Archery, Mfg. LLC., Fayetteville, Pennsylvania, "High Let Off Bows" Product Brochure, no date.
HCA (High Country Archery, Inc.), Dunlap, Tennessee, "2004 Bows & Accessories" Product Catalog, pp. 6-7, 42-43.
Hoyt USA, Salt Lake City, Utah, "Product Guide 2004", p. 12.
Jakes Archery, Orem, Utah, "2004-2005" Product Guide, pp. 56-66.
Kodiak Outdoors, Tempe, Arizona, "2004 BowLogic" Product Guide.
Merlin Bows, Rindge, New Hampshire, "Merlin Product Guide 2004".
PSE Archery, Tucson, Arizona, "2004 Archery Products Catalog", pp. 40-42.
Richwood Archery, Huntington, WV, 2004 Product Catalog, p. 7.
The U.S. and International Archer, Tucson, Arizona, Product Catalog, Nov.-Dec. 2004, vol. 23, No. 6, pp. 275, 298-300, 319 and 320.
Cabela's Archery, 2004 Catalog by Cabela's Inc., Sidney, Nebraska, pp. 60-66.
Keystone Country Store's Bowhuntng, Fall 2004 Catalog, Chambersburg, PA, pp. 64-73.

* cited by examiner

PRODUCTS AND PROCESSES FOR ARCHERY AND FIREARM SIGHTS

FIELD OF THE INVENTION

This invention generally relates to archery and firearm sight products and processes, and more particularly to sight rings.

BACKGROUND

An archer's or shooter's ability to successfully land an arrow or bullet on target, particularly in the field, depends on several factors. One of these factors is the ability of an archer to make adjustments to a sighting device with precision and with relative ease. However, making adjustments to known sighting devices generally involve a series of complicated, time-consuming steps that may require the use of tools and/or either placing the bow down to make the adjustments or to use both hands.

With some multi-aiming pin devices, it may not be possible or easy to manipulate an aiming pin individually or independently from the other aiming pins. Additionally, the complex mechanisms used by some current sighting devices may add additional weight to a bow, which over time may contribute to an archer's fatigue and thus, may reduce an archer's accuracy.

Other factors may influence an archer's or shooter's accuracy, including one's ability to acquire and align a target. A variety of methods and devices have been used to allow one to accurately center a sight in a peep. Some sights are produced with a solid white or orange ring painted onto an end of the sight ring facing the archer or shooter. A purpose of painting a sight ring generally may be to allow one to visually acquire the sight ring more readily in low light conditions. This approach, however, suffers from a number of disadvantages.

One disadvantage is that one may lose focus of the sight ring while attempting to acquire a target. The subjective brightness of an object is determined by the human brain by comparing the visual intensity, i.e., contrast, of the object with surrounding objects. Thus, to compare brightness of a painted sight ring, one must compare the painted sight ring to objects in the background, which may be 20 or more yards away. Thus, one may lose focus of the sight ring, as well as the target, while attempting to perceive the brightness of, and thus visually acquire, the sight ring.

Another disadvantage is that aligning the sight ring and the peep may require a relatively high degree of precision, i.e., skill, and thus require more time than desired. To accurately sight-in a target using known sight rings, one must align a peep with the sight ring and the target. Both the peep and the sight ring are generally circular. Thus, to properly sight-in a target one must attempt to form concentric circles (the peep must circumscribe and share a common axis with the sight ring). Again, such devices and methods require a fair amount of skill to achieve an accurate shot.

What is needed are products and processes for archery and firearm sights, which can permit an archer or shooter to more easily and more quickly acquire and align a target in a sight ring and a peep for a more accurate shot. Also, what is needed is the ability to make adjustments to the sighting device with relative ease and without the use of tools.

SUMMARY

Embodiments of the present invention comprise products and processes for archery and firearm sights. One aspect of the present invention may comprise a sight ring comprising a proximal end and a distal end, a plurality of first lines coupled with the proximal end of the sight ring, and a plurality of second lines coupled with the proximal end of the sight ring. The plurality of first and second lines may be arranged in an alternating pattern about the sight ring.

Another aspect of the present invention may comprise a sight ring and a shaft. The sight ring may comprise a proximal end, a distal end, and a track. The track may comprise a major axis disposed substantially parallel with a vertical axis of the sight ring. The shaft may comprise a first end, a second end opposite the first end, and a body disposed between the first and second ends of the shaft. The first end of the shaft may be removably coupled with the sight ring and may be adapted to be displaced along the track of the sight ring.

Still another aspect of the present invention may comprise a sight ring defining an orifice, a guide rod and an adjustment screw coupled with the sight ring, and an aiming pin comprising a first end and a second end opposite the first end. The guide rod may comprise a major axis disposed substantially parallel with a vertical axis of the sight ring. The adjustment screw may be disposed substantially parallel with the guide rod. The first end of the aiming pin may be disposed in the orifice defined by the sight ring. The second end of the aiming pin may be coupled with the guide rod and the adjustment screw.

Still another aspect of the present invention may comprise a sight ring, a plurality of first and second lines, a shaft, and a linkage. The sight ring may comprise a proximal end, a distal end, and a track. The plurality of first lines may comprise a first color formed on the proximal end of the sight ring and the plurality of second lines may comprise a second color complementary to the first color formed on the proximal end of the sight ring. The plurality of first and second lines may be arranged in an alternating pattern about the sight ring. The shaft may comprise a first end, a second end opposite the first end, and a body disposed between the first and second ends of the shaft. The first end of the shaft may be removably coupled with the sight ring and may be adapted to be displaced along the track. The linkage may be adapted to be coupled with an archery bow and may comprise an orifice forming a complementary surface with the body of the shaft. The linkage and the shaft may be adapted to be displaced relative to one another.

Still another aspect of the invention may comprise providing a sight ring comprising a proximal end and a distal end, coupling a plurality of first lines with the proximal end of the sight ring, and coupling a plurality of second lines with the proximal end of the sight ring. In one embodiment, the plurality of first and second lines may be arranged in an alternating pattern about the sight ring.

Still another aspect of the invention may comprise providing a sight ring and providing a shaft. The sight ring may comprise a proximal end, a distal end, and a track. The shaft may comprise a first end, a second end opposite the first end, and a body disposed between the first and second ends of the shaft. The first end of the shaft may be adapted to be removably coupled with the sight ring and to be displaced along the track.

Yet another aspect of the present invention may comprise providing a sight ring defining an orifice, coupling a guide rod and an adjustment screw with the sight ring, and providing an aiming pin comprising a first end and a second end opposite the first end. The guide rod may comprise a major axis disposed substantially parallel with a vertical axis of the sight ring. The adjustment screw may be disposed substantially parallel with the guide rod. The first end of the aiming pin may be disposed in the orifice defined by the sight ring and the second end of the aiming pin may be coupled with the guide rod and the adjustment screw.

These exemplary embodiments are mentioned not to limit or define the invention, but to provide an example of an embodiment of the invention to aid understanding thereof. Exemplary embodiments are discussed in the Detailed Description, and further description of the invention is provided there. Advantages offered by the various embodiments of the present invention may be further understood by examining this specification.

BRIEF DESCRIPTION OF THE DRAWINGS

These and other features, aspects, and advantages of the present invention are better understood when the following Detailed Description is read with reference to the accompanying drawings, wherein.

DETAILED DESCRIPTION

Figure 1:
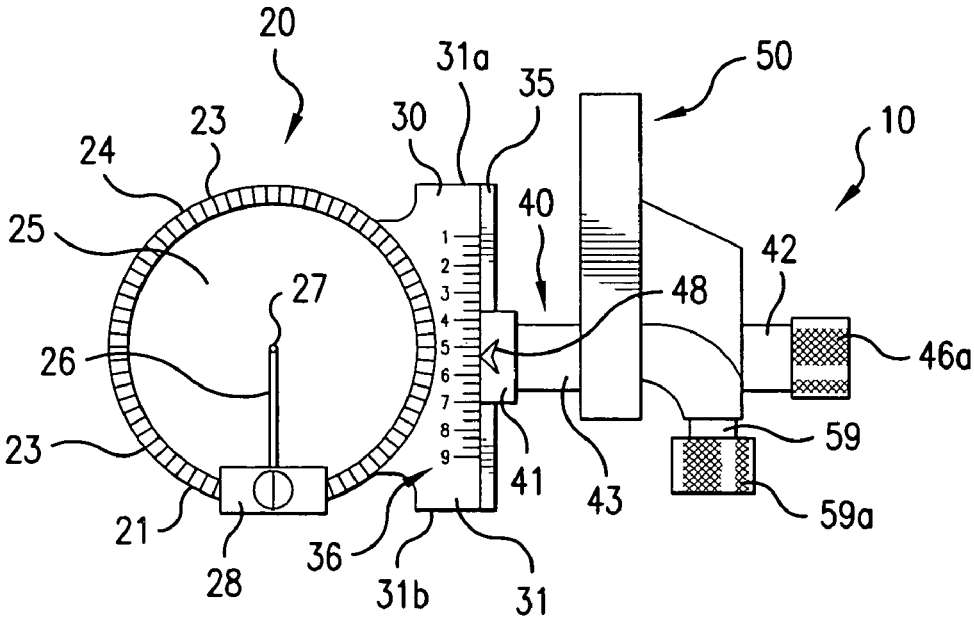
FIG. 1 shows an elevation view of an archery sight according to an embodiment of the present invention.
Figure 2:
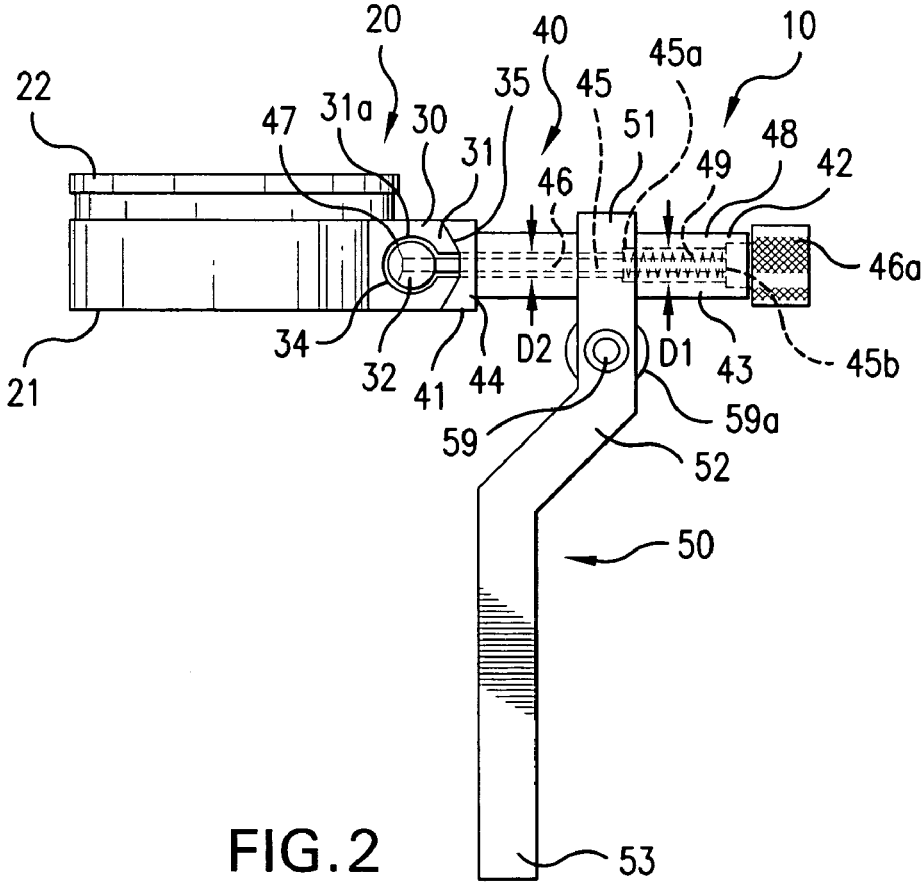
FIG. 2 shows a plan view of the archery sight of FIG. 1.
Figure 3:
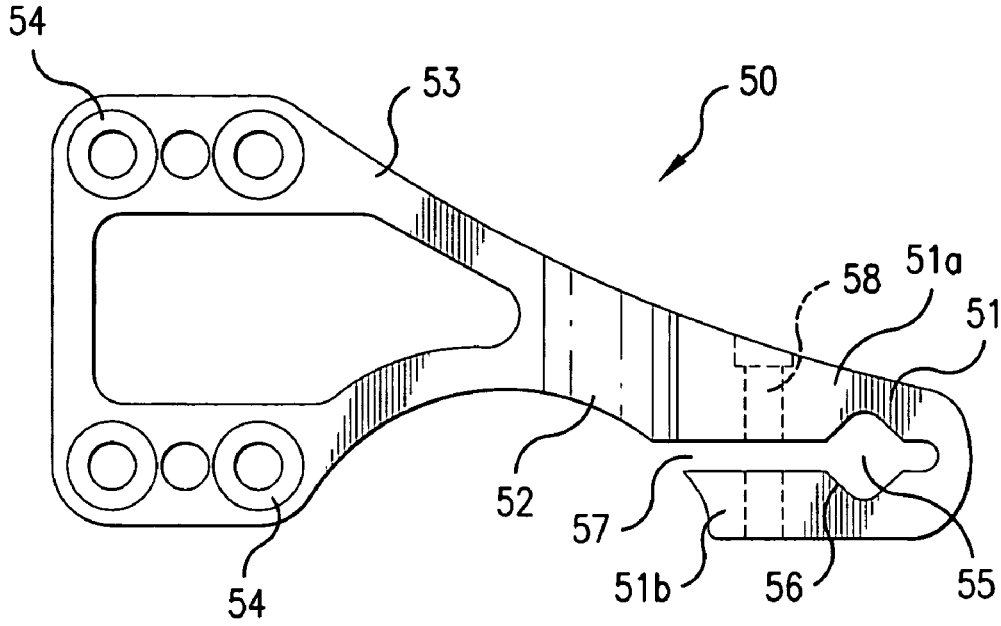
FIG. 3 shows a side view of a linkage of the archery sight of FIG. 1.

Embodiments of the present invention comprise products and processes for archery and firearm sights. Referring now to FIGS. 1-3, an exemplary archery sight 10 is shown. The archery sight 10 may comprise a sight ring 20, a shaft 40, and a linkage 50. The archery sight 10 may be made of aluminum, or other suitable materials. As will be described below if further detail, the archery sight 10 may be coupled with an archery bow (not shown).

The sight ring 20 may comprise a proximal end 21 and a distal end 22. The terms "proximal" and "distal" and terms of position, such as "behind," "above," "front," "vertical," "horizontal," etc., refer to positions with respect to one handling an archery bow (not shown) or firearm (not shown) in a traditional manner. The sight ring 20 may comprise a substantially circular shape. The sight ring 20 may be formed of a unitary element, or may be formed of multiple elements coupled together.

The sight ring 20 may comprise a plurality of first lines 23 and a plurality of second lines 24 coupled with the proximal end 21 of the sight ring 20. In one embodiment, the plurality of first lines 23 and the plurality of second lines 24 may be arranged in an alternating pattern. In one embodiment, a width of each one of the plurality of first lines 23 may be less than a width of each one of the plurality of second lines 24. Alternatively, other suitable widths may be used.

The plurality of first lines 23 and the plurality of second lines 24 may be distributed uniformly about the proximal end 21 of the sight ring 20. In one embodiment, the plurality of first lines 23 and the plurality of second lines 24 may be distributed or arranged otherwise. For example the plurality of first lines 23 may be formed at the 12 o'clock, 3 o'clock, 6 o'clock, and 9 o'clock positions in a cross-like pattern or arrangement.

In one embodiment, the plurality of first lines 23 and the plurality of second lines 24 may extend radially from a center of the sight ring 20. The plurality of first lines 23 and the plurality of second lines 24 may be formed in the proximal end 21 of the sight ring 20. For example, the plurality of first lines 23 and the plurality of second lines 24 may be formed or etched onto the proximal end 21 of the sight ring 20, such as by laser etching.

In one embodiment, one or more of the plurality of first lines 23 may be formed entirely on the proximal end 21 of the sight ring 20. In another embodiment, the plurality of first lines 23 may be formed on only a portion, section, or segment of the proximal end 21 of the sight ring 20. Similarly, the plurality of second lines 24 may be formed entirely on the proximal end 21 of the sight ring 20. Alternatively, the plurality of second lines 24 may be formed on only a portion, section, or segment of the proximal end 21 of the sight ring 20.

In one embodiment each one of the plurality of first lines 23 may comprise a first color and each one of the plurality of second lines 24 may comprise a second color. The second color may be complementary to the first color. Each one of the plurality of first lines 23 may comprise a white line and each one of the plurality of second lines 24 may comprise a black line.

The sight ring 20 may define an orifice 25 in which an aiming pin 26 may be disposed. The sight ring 20 may be adapted to support and/or house an aiming pin 26. The aiming pin 26 may be fixed or formed integrally with the sight ring 20. Alternatively, the aiming pin 26 may be adapted to be removed from the sight ring 20. The aiming pin 26 may extend from the 6 o'clock position of the sight ring 20. In another embodiment, the aiming pin 26 may extend from the 3 o'clock position.

In one embodiment, a fiber optic filament 27 may be disposed in communication with the aiming pin 26. In another embodiment, the fiber optic filament 27 may be coupled with the aiming pin 26. The fiber optic filament 27 may collect ambient light and direct or emit such collimated light on the aiming pin 26. The fiber optic filament 27 may be wound about the sight ring 20. Wrapped coils (not shown) of fiber optic filament 27 generally provide a greater surface area on which to capture ambient light than a single strand of fiber optic filament 27.

A level 28 may be coupled to the sight ring 20, for example at the 6 o'clock position, to assist the archer in maintaining the bow (not shown) in a position substantially vertical with the ground.

A ring interface 30 may be coupled to the sight ring 20. The ring interface 30 may be formed integrally with the sight ring 20. Alternatively, the ring interface 30 may be formed separately from the sight ring 20 and coupled with the sight ring 20 by, for example, a fastener (not shown).

The ring interface 30 may comprise a substantially rectangular interface housing 31. The interface housing 31 may comprise a series of gradations 36 to facilitate an archer in making range adjustments. A length of the interface housing 31 may be substantially equal to a diameter of the sight ring 20. Alternatively, the length of the interface housing 31 may be greater or less than the diameter of the sight ring 20. A major axis of the interface housing 31 may be substantially parallel with the vertical axis of the sight ring 30.

The interface housing 31 may comprise a cavity 32 forming a track 34. The cavity 32 and track 34 may extend entirely through the length of the interface housing 31 from a first end 31*a* to a second end 31*b* in an interior of the interface housing 31. The track 34 may comprise a major axis disposed substantially parallel with a vertical axis of the sight ring. In one embodiment, the track 34 may be formed on an exterior of the interface housing 31. A cross-section of the cavity 32 may be substantially circular. Alternatively, the cross-section of the cavity 32 may be other suitable shapes.

The archery sight 10 may comprise a shaft 40. The shaft 40 may comprise a first end 41, a second end 42 opposite the first end 41, and a body 43 disposed between the first end 41 and the second end 42. The first end 41 may comprise a flange 44 forming a complementary surface with an interface surface 35 of the interface housing to facilitate engagement of the shaft 40 with the ring interface 30, and thus sight ring 20.

The flange 44 may include a marker 48, such as an arrowhead or other suitable pointer, to facilitate an archer's visual adjustment of the sight ring 20 in a vertical direction. Generally the marker points to the range gradations 36 formed or etched on the interface housing 31.

The first end 41 of the shaft 40 may be removably coupled with the sight ring 20. In one embodiment, a passage 45 may be formed within an interior of the shaft 40 from the first end 41 to the second end 42. The passage may comprise a first diameter D1 and a second diameter D2. The first diameter D1 may be greater than the second diameter D2.

A spring 49 may be disposed in the passage 45 and one end of the spring may rest against a first ridge 45*a* formed in the passage 45. A screw 46 may be disposed within the passage 45 and within the spring 49. One end of the screw 46 may be engaged with or threaded into a first adjustment nut 46*a*. The other end of the screw 46, i.e., proximate the head (not shown) of the screw 46, may be engaged with or threaded through a dowel nut 47. A diameter of the head of the screw 46 may be greater than a diameter of a passage (not shown) formed in the dowel nut 47.

The dowel nut 47 may be sized to fit within the cavity 32 of the ring interface 30. In one embodiment, the dowel nut 47 may form a snug fit with the track 34 of the ring interface 30. However, there may be sufficient clearance between the track 34 and the dowel nut 47 to permit the dowel nut 47 to travel along the track 34 when the first adjustment nut 46*a* has been loosened. Thus, the shaft 40 and the sight ring 20 may be displaced relative to one another.

When the first adjustment nut 46*a* is fully engaged or tightened, the first adjustment nut 46*a* may be disposed against the second ridge 45*b* formed in the passage 45 of the shaft 40. Tightening the first adjustment nut 46*a* may engage the screw 46 into an internal body of the first adjustment nut 46*a*, compressing the head of the screw 46 against the dowel nut 47, which may close a gap between the dowel nut 47 and the track 34, thus locking the flange 44 of the shaft 40 and the interface surface 35 of the sight ring 20 together.

Loosening the first adjustment nut 46*a* may release the screw 46 from the dowel nut 47, which may create or increase a gap between the dowel nut 47 and the track 34. With sufficient clearance between the flange 44 of the shaft 40 and the interface surface 35 of the sight ring 20, the shaft 40 and the sight ring 20 may be displaced relative to one another. As the first end 31*a* and the second end 31*b* of the interface housing may be open, the sight ring 20 and the shaft 40 may be removed readily from engagement with one another. To further facilitate coupling and disengagement of the sight ring 20 and the shaft 40, the adjustment nut 46*a* may be adjusted manually, i.e., by hand without the use of tools.

The archery sight 10 may comprise a linkage 50. The linkage 50 may be made of the same material as the shaft 40 and the sight ring 20. Other suitable materials may be used. The linkage 50 may comprise a first leg 51, a second leg 53, and an intermediate section 52 joining the first leg 51 and the second leg 53. The first leg 51 and the second leg 53 may be offset from and parallel to one another. The intermediate section 52 may be disposed in an angular orientation. In one embodiment, the intermediate section 52 may be disposed approximately at a 45 degree angle with respect to the first leg 51.

The linkage 50 may be adapted to be coupled with an archery bow. As shown in FIG. 3, the linkage 50 may comprise a plurality of first orifices 54 for bolts or other fastening devices to couple the linkage 50 with an archery bow. The linkage 50 may be coupled with the shaft 40.

The linkage 50 may comprise a second orifice 55 adapted to couple the linkage 50 with the shaft 40. In one embodiment, the second orifice 55 may be disposed in the first leg 51. The second orifice 55 may comprise an orifice surface 56 complementary to an outer surface 48 of the body 43 of the shaft 40. In one embodiment, a cross-section of the outer surface 48 of the shaft 40 may comprise a substantially diamond-like shape. Other suitable shapes may be used.

The first leg 51 may comprise a first portion 51*a* and a second portion 51*b*. The second portion 51*b* may be cantilevered from the first portion 51*a*. The first portion 51*a* and the second portion 51*b* may define a gap 57, which may extend to the second orifice 55. The gap 57 may provide clearance between the orifice surface 56 and the outer surface 48 of the shaft 40, which may facilitate the displacement of the shaft 40 and the linkage 50 relative to one another.

The gap 57 may be reduced by displacing the first portion 51*a* and the second portion 51*b* closer to one another. For example, the second portion 51*b* may move closer to the first portion 51*a* by compressing the second portion 51*b*. Sufficiently reducing the gap 57 may engage or lock together the shaft 40 and the linkage 50.

A linkage passage 58 may be formed in the first leg 51 through the gap 57. The linkage passage 58 may accommodate a locking bolt 59, which when tightened, may reduce the clearance formed by the gap 57, thus engaging together the orifice surface 56 and the outer surface 48 of the shaft 40. A second adjustment nut 59*a* may be coupled to the locking bolt 59. The second adjustment nut 59*a* may be adjusted manually, i.e., by hand without the use of tools.

Figure 4A:
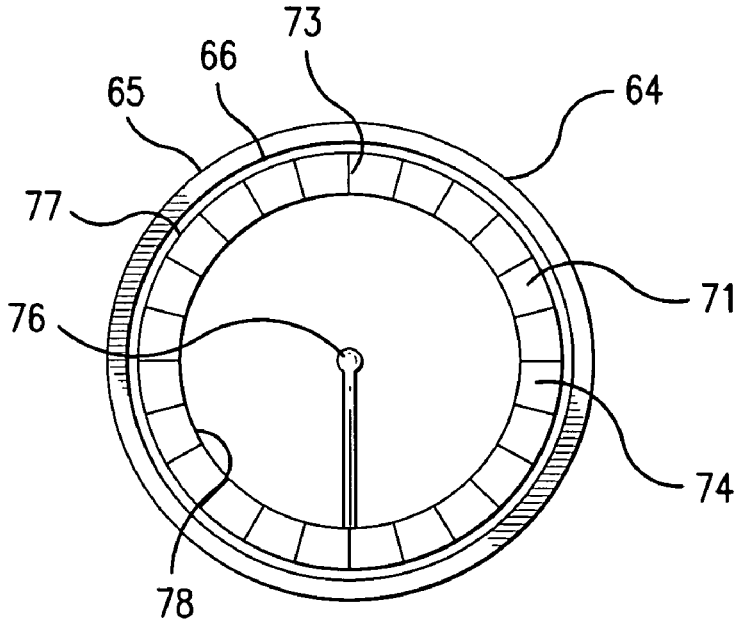
FIG. 4A shows a view as seen by a shooter looking through the firearm sight of FIG. 4.
Figure 4:
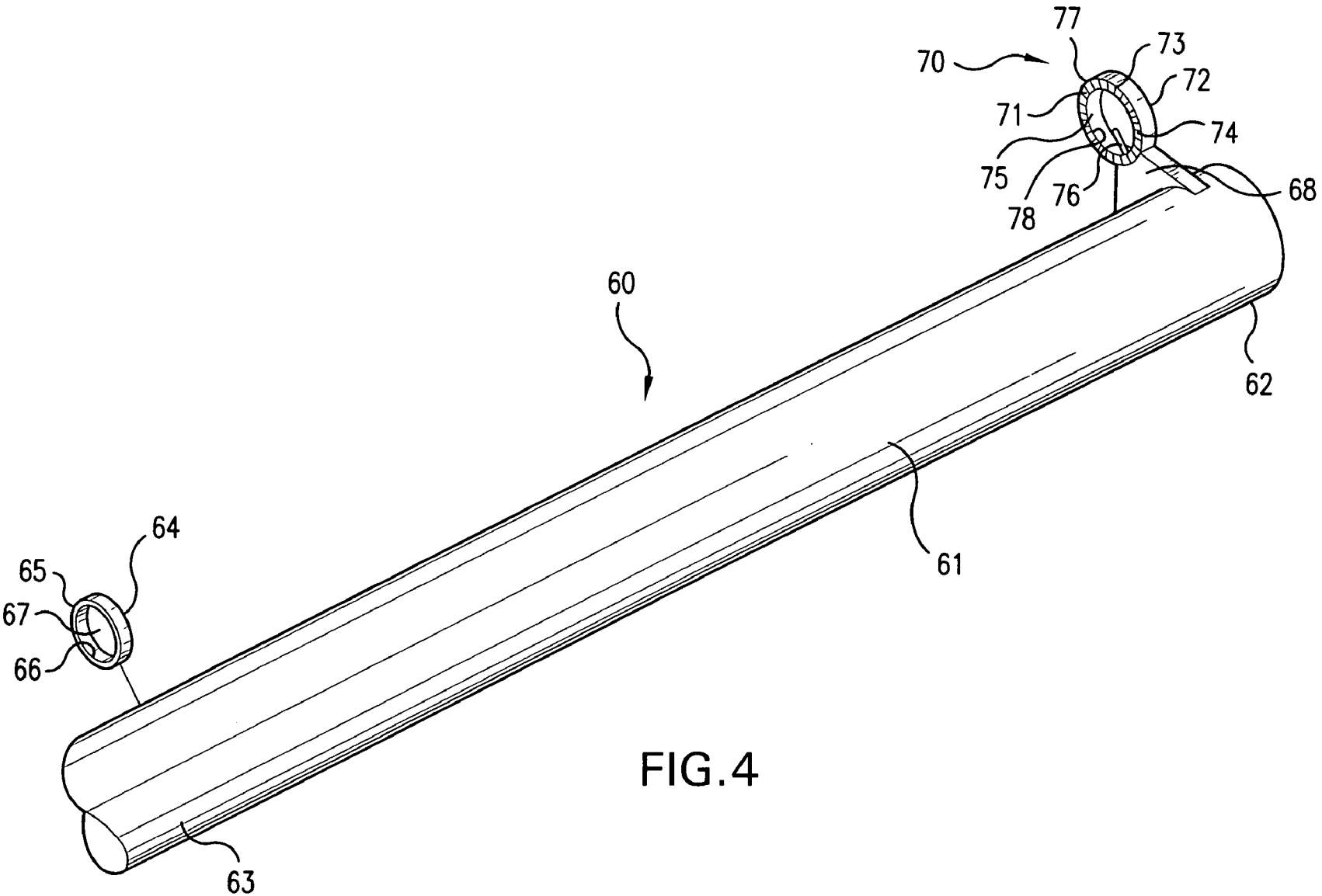
FIG. 4 shows an orthogonal view of a firearm sight according to an embodiment of the present invention.

Referring now to FIG. 4, an orthogonal view of a firearm sight 70 according to an embodiment of the present invention is shown. The firearm sight 70 may be coupled with a firearm 60. The firearm 60 is a cutaway view of a rifle. The sight 70 may be used on other firearms (such as a sidearm), weapons, and other aiming systems and products.

The firearm 60 may comprise a gun barrel 61 comprising a first end 62 and a second end 63 opposite the first end 62. The second end 63 is proximate a stock (not shown) of the firearm 60. A peep sight 64 may be attached to the second end 63 of the firearm 60. Alternatively, the peep sight 64 may be coupled with another portion of the firearm 60. For example, the peep sight 64 may be attached to the stock. The peep sight 64 may comprise an outer edge 65 and an inner edge 66. The inner edge 66 of the peep sight 64 may define an orifice 67 of the peep sight 64.

A sight ring 70 may be disposed opposite and substantially aligned with the peep sight 64. The sight ring 70 may be coupled with the first end 62 of the firearm 60. For example, the sight ring 70 may be permanently affixed, mounted, or attached to the firearm 60 by a sight mount 68. Alternatively, the sight ring 70 may be removably coupled with the firearm 60.

The sight ring 70 may comprise a proximal end 71 and a distal end 72. The sight ring 70 may comprise a plurality of first lines 73 and a plurality of second lines 74 coupled with the proximal end 71 of the sight ring 70. The plurality of first lines 73 and the plurality of second lines 74 may be arranged in an alternating pattern. The plurality of first lines 73 and the plurality of second lines 74 may be distributed uniformly about the proximal end 71 of the sight ring 70. In one embodiment, the plurality of first lines 73 and the plurality of second lines 74 may be distributed or arranged otherwise. For example, the plurality of first lines 23 may be formed at the 12 o'clock, 3 o'clock, 6 o'clock, and 9 o'clock positions.

The plurality of first lines 73 and the plurality of second lines 74 may extend radially from a center of the sight ring 70. The plurality of first lines 73 may extend from an outer edge 77 to an inner edge 78 of the proximal end 71 of the sight ring 70. The plurality of first lines 73 and the plurality of second lines 74 may be formed in the proximal end 71 of the sight ring 70. For example, the plurality of first lines 73 and the plurality of second lines 74 may be formed or etched onto the proximal end 71 of the sight ring 70, such as by laser etching.

In one embodiment, each one of the plurality of first lines 73 may comprise a first color and each one of the plurality of second lines 74 may comprise a second color. The second color may be complementary to the first color. Each one of the plurality of first lines 73 may comprise a white line and each one of the plurality of second lines 74 may comprise a black line. Other suitable colors may be used.

The sight ring 70 defines an orifice 75 in which an aiming pin 76 may be disposed. The sight ring 70 may support and/or house the aiming pin 76. In one embodiment, the aiming pin 76 may be fixed or formed integrally with the sight ring 70. In another embodiment, the aiming pin 76 may be removably engaged with the sight ring 70. The aiming pin 76 may extend from the 6 o'clock position. Alternatively, the aiming pin 76 may extend from other suitable positions.

Referring now to FIG. 4A, a view from a shooter's perspective looking through the orifice 67 of the peep sight 64 aligned with the sight ring 70 on a target (not shown). A similar view may be obtained with the embodiments herein directed to an archery bow.

To accurately aim the firearm 60, the shooter should visually acquire a target and look through the peep sight 64 at the target. The shooter continues to look through the peep sight 64 and aligns the inner edge 66 of the peep sight with the outer edge 77 of the sight ring 70. As shown, the plurality of first lines 73 of the sight ring 70 may facilitate proper and easy alignment of the peep sight 60 and the sight ring 70.

To optimize the accuracy of the shot, there should be no gap between the outer edge 77 of the sight ring 70 and the inner edge 66 of the peep sight 64. The accuracy of the shot may generally be increased by increasing a distance between the peep sight 64 and the sight ring 70. The aiming pin 76 should remain on the target while the peep sight 64 and the sight ring 70 are aligned.

Alternating the first lines 73 with the second lines 74 on the same surface, i.e., the proximal end 71 of the sight ring 70, may permit the shooter or archer to determine brightness of the sight ring 70 at the same focal distance rather than seeking contrast with the background. A shooter may more readily center a series of radial lines (i.e., the plurality of first lines 73 and/or the plurality of second lines 74) inside a circle (e.g., the peep sight 64) than one can center two circles of similar, though different diameters. This exemplary process of using the principles of the present invention to sight a target also may be used with the arrow sights described herein, and thus will not be repeated or described further.

Referring now to FIGS. 5-8, an alternate embodiment of an archery sight 80 is shown. Like elements with the embodiment of the archery sight 10 described above and with reference to FIGS. 1-3 will not be repeated here. The archery sight 80 may comprise a sight ring 90, the shaft 40, and the linkage 50. The sight ring 90 may comprise a proximal end 91 and a distal end 92. The sight ring 90 may comprise a substantially circular shape. The sight ring 90 may be formed of a unitary element or of multiple components coupled together.

The sight ring 90 may comprise a plurality of first lines 93 and a plurality of second lines 94 coupled with the proximal end 91 of the sight ring 90. In one embodiment, the plurality of first lines 93 and the plurality of second lines 94 may be arranged in an alternating pattern. The plurality of first lines 93 and the plurality of second lines 94 may be distributed uniformly about the proximal end 91 of the sight ring 90. In one embodiment, the plurality of first lines 93 and the plurality of second lines 94 may be distributed or arranged otherwise. For example, the plurality of first lines 93 may be formed at the 12 o'clock, 3 o'clock, 6 o'clock, and 9 o'clock positions.

In one embodiment, the plurality of first lines 93 and the plurality of second lines 94 may extend radially from a center of the sight ring 90. The plurality of first lines 93 and the plurality of second lines 94 may be formed on a surface of the proximal end 91 of the sight ring 90. For example, the plurality of first lines 93 and the plurality of second lines 94 may be formed or etched onto the proximal end 91 of the sight ring 90, such as by laser etching.

In one embodiment, each one of the plurality of first lines 93 may comprise a first color and each one of the plurality of second lines 94 may comprise a second color. The second color may be complementary to the first color. Each one of the plurality of first lines 93 may comprise a white line and each one of the plurality of second lines 94 may comprise a black line.

The sight ring 90 defines an orifice 95 in which a plurality of aiming pins 96 may be disposed. In one embodiment, there may be three aiming pins 96, a first aiming pin 96*a*, a second aiming pin 96*b*, and a third aiming pin 96*c*. Alternatively, other suitable numbers of aiming pins 96 may be used. The sight ring 90 may be adapted to support and/or house the plurality of aiming pins 96. In one embodiment, the plurality of aiming pins 96 may extend from the 3 o'clock position. Alternatively, the plurality of aiming pins 96 may extend from other suitable positions.

Figure 5:
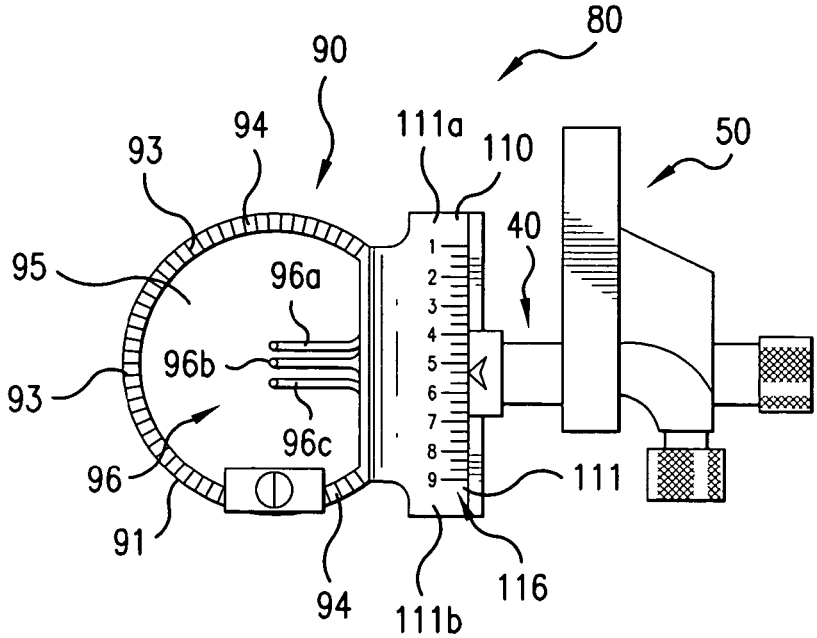
FIG. 5 shows an elevation view of an archery sight according to another embodiment of the present invention.
Figure 6:
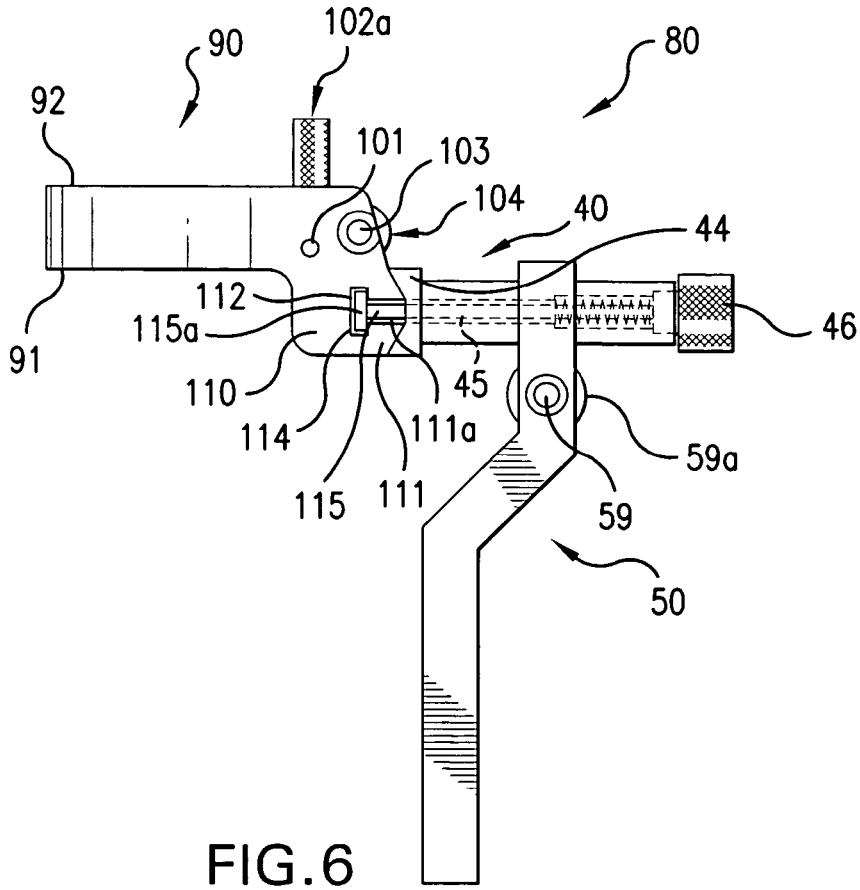
FIG. 6 shows a plan view of the archery sight of FIG. 5.
Figure 7:
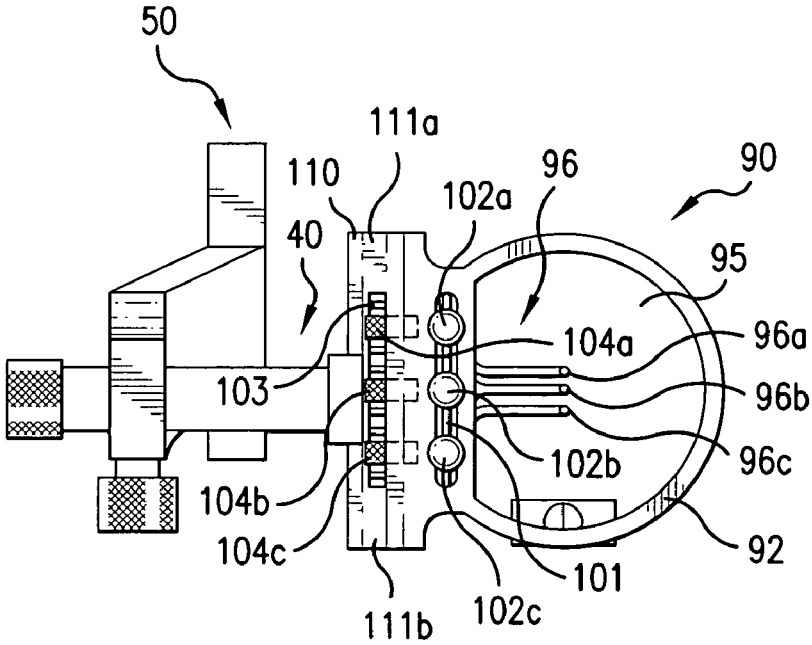
FIG. 7 shows another elevation view of the archery sight of FIG. 5.
Figure 8:
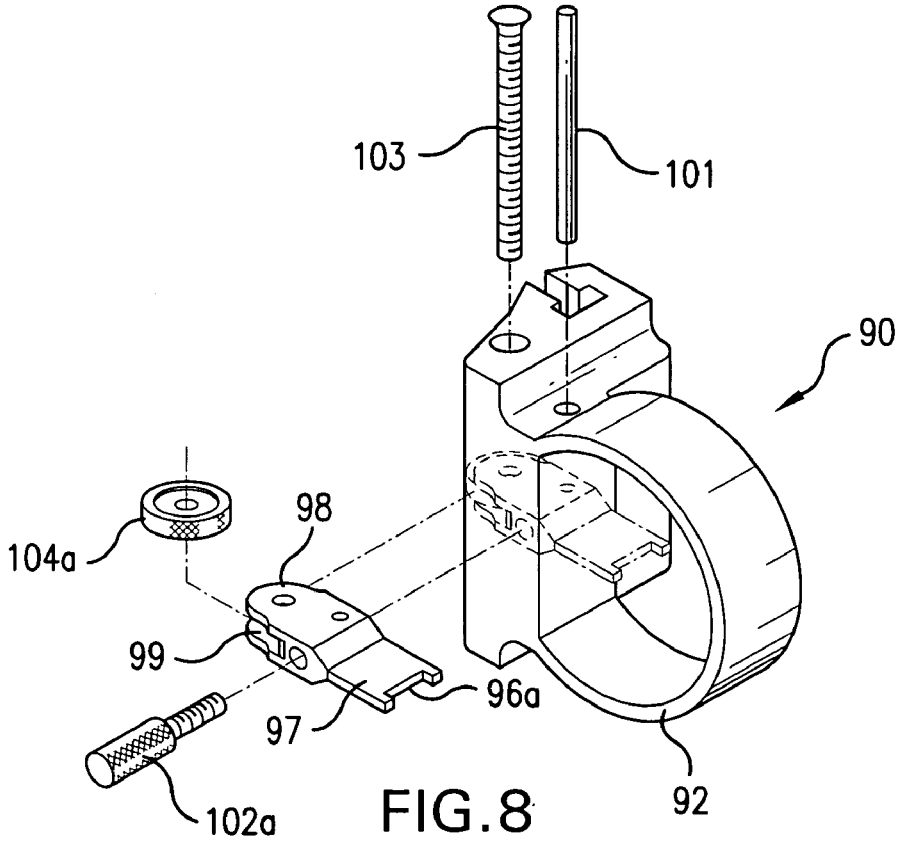
FIG. 8 shows an exploded view of the sight ring of FIG. 7.

Each of the aiming pins 96 may be substantially similar to one another. Thus, only the first aiming pin 96*a* will be described in further detail. FIG. 8 is an exploded view of the sight ring 90 showing further detail and configuration of the first aiming pin 96*a* with respect to the sight ring 90. For the sake of clarity, several details present in the sight ring 90 are not shown in FIG. 8. These other details are shown in FIGS. 5-7.

The first aiming pin 96*a* may comprise a first end 97 and a second end 98 opposite the first end 97. The first end 97 of the first aiming pin 96*a* may be disposed in the orifice 95 defined by the sight ring 90. The second end 98 of the first aiming pin 96*a* may be coupled with a guide rod 101 and an adjustment screw 103.

The guide rod 101 may be coupled with the sight ring 90 and may comprise a substantially solid, cylindrically-shaped pin. A major axis of the guide rod 101 may be substantially parallel with a vertical axis of the sight ring 90. Each one of the plurality of aiming pins 96 may be coupled with the guide rod 101. Alternatively, each one of the plurality of aiming pins 96 may be coupled with a plurality of guide rods (not shown), i.e., each of the aiming pins coupled individually with a respective guide rod. Each one of the plurality of aiming pins 96 may be adapted to travel along the guide rod 101. For example, the second end 98 of the first aiming pin 96*a* may be slidingly coupled with the guide rod 101 and may be adapted to travel along the guide rod 101 in a vertical direction.

Each one of the plurality of aiming pins 96 may also be coupled with an adjustment screw 103. A major axis of the adjustment screw 103 may be substantially parallel with a vertical axis of the sight ring 90. Each one of the plurality of aiming pins 96 may be coupled with the adjustment screw 103. For example, the second end 98 of the first aiming pin 96*a* may be adjustably coupled with the adjustment screw 103. Alternatively, each one of the plurality of aiming pins 96 may be coupled with a plurality of adjustment screws (not shown), i.e., each of the aiming pins 96 coupled individually with a respective adjustment screw.

Each one of the plurality of aiming pins 96 may be adapted to travel along the adjustment screw 103. For example, the second end 98 of the first aiming pin 96*a* may be coupled with the adjustment screw 103 and may be adapted to travel along the adjustment screw 103 in a vertical direction. Thus, the second end 98 of the first aiming pin 96*a* may be coupled with both the guide rod 101 and the adjustment screw 103.

In one embodiment, there may be an adjustment wheel 104 for each one of the aiming pins 96. For example, a first adjustment wheel 104*a* may be coupled with the first aiming pin 96*a*, a second adjustment wheel 104*b* may be coupled with the second aiming pin 96*b*, and a third adjustment wheel 104*c* may be coupled with the third aiming pin 96*c*. For example, the second end 98 of the first aiming pin 96*a* may comprise a yoke 99. The yoke 99 may be adapted to receive the first adjustment wheel 104*a*. In one embodiment, the yoke 99 may be substantially U-shaped in cross-section. The second end 98 of the first aiming pin 96*a* may be coupled with both the adjustment screw 103 and the guide rod 101. The second end of the first aiming pin 96*a* may be threadably coupled with the adjustment screw 103.

A vertical position one of the aiming pins 96 may be adjusted independently of the other aiming pins 96, as well as being adjusted manually, i.e., without the use of tools. For example, the vertical position of the first aiming pin 96*a* may be adjusted by a user manipulating or actuating (i.e., rotating) the first adjustment wheel 104*a* about the adjustment screw 103, which remains fixed with respect to the sight ring 90.

As the first adjustment wheel 104*a* travels up or down the adjustment screw 103, it exerts a force against the yoke 99, which displaces the first aiming pin 96*a* along both the adjustment screw 103 and the guide rod 101. Using both the adjustment screw 103 and the adjustment wheel 104 may permit a steady and controllable movement of the aiming pins 96 (i.e., fine adjustment).

The aiming pins 96 may be secured in place 101 by a plurality of guide rod set screws 102. In one embodiment, there may be a guide rod set screw 102 for each one of the aiming pins 96. For example, a first guide rod set screw 102*a* may correspond to the first aiming pin 96*a*, a second guide rod set screw 102*b* may correspond to the second aiming pin 96*b*, and a third guide rod set screw 102*c* may correspond to the third aiming pin 96*c*.

Each guide rod set screw 102 may be coupled with each aiming pin 96. For example, the first guide rod set screw 102*a* may be coupled with the first aiming pin 96*a*. The first guide rod set screw 102*a* may be disposed between the first end 97 and the second end 98 of the first aiming pin 96*a*. The first guide rod set screw 102*a* may be disposed proximate the yoke 99.

The guide rod set screws 102 may prevent the movement of the aiming pins 96 by creating a frictional or locking engagement with a surface of the guide rod 101. Releasing or loosening the frictional or locking engagement formed between the set screws 102 and the guide rod 101 may permit the aiming pins 96 to travel along the guide rod 101.

For example, a portion of the first guide rod set screw 102*a* may be disposed through a portion of the first aiming pin 96*a*. In one embodiment, a threaded orifice may be formed in the first aiming pin 96*a*, with which a threaded portion of the first guide rod set screw 102*a* may be threadably engaged. Threading the first guide rod set screw 102*a* through the first aiming pin 96*a* until there is sufficient contact or engagement between the first guide rod set screw 102*a* and the guide rod 101 may create a frictional or locking engagement such that the first aiming pin 96*a* cannot be displaced by external forces acting on the first aiming pin 96*a*.

Each one of the plurality of aiming pins 96 may be adapted to be displaced independently of the other aiming pins 96. For example, to adjust a vertical position of the first pin 96*a*, a user may loosen or release the first guide pin set screw 102*a* from contact with the guide rod 101, rotate the first adjustment wheel 104*a* such that the first pin 96*a* travels along the guide rod 101 and the adjustment screw 103 to a desired position, and tighten the first guide rod set screw 102*a* against the guide rod 101 to secure the first pin 96*a* in place.

As the plurality of guide rod set screws 102 and the plurality of adjustment wheels 104 may be manipulated manually, i.e., by hand without the use of tools, each one of the plurality of aiming pins 96 may be adapted to be adjusted manually. Thus, eliminating the need for tools to make adjustments to the aiming pins 96, may increase the ease of use of the archery sight 80, especially in the field.

As the plurality of aiming pins 96 each are associated with respective guide rod set screws 102 and adjustment wheels 104, each aiming pin 96 may be adjusted or manipulated independently of the other aiming pins 96. Independent adjustment of the plurality of aiming pins 96, may decrease the complexity the amount of time required to make adjustments. Thus, the ease of use of the archery sight may be increased, especially in the field.

A ring interface 110 may be coupled with the sight ring 90. The ring interface 110 may be offset from the sight ring 90. The ring interface 110 may be formed integrally with the sight ring 90. Alternatively, the ring interface 110 may be formed separately from the sight ring 90 and coupled with or attached to the sight ring 90 by, for example, welding.

The ring interface 110 may comprise a substantially rectangular interface housing 111. The interface housing 111 may comprise a series of gradations or markings 116 to facilitate an archery in making range adjustments. A length of the interface housing 111 may be substantially equal to a diameter of the sight ring 90. Alternatively, the length of the interface housing 111 may be greater than the diameter of the sight ring 90. A major axis of the interface housing 111 may be substantially parallel with a vertical axis of the sight ring 90.

The interface housing 111 may comprise a cavity 112 forming a track 114 in an interior of the interface housing 111. In one embodiment, the track 114 may be formed on an exterior surface of the interface housing 111. The track 114 may comprise a major axis disposed substantially parallel with a vertical axis of the sight ring. The cavity 112 and track 114 may extend entirely through the length of the interface housing 111 from a first end 111*a* to a second end 111*b*. A cross-section of the cavity 112 may be substantially T-shaped. Alternatively, other suitable cross-sections may be used for the cavity 112.

Coupling the shaft 40 with the sight ring 90 is substantially similar to the embodiment described above and with reference to FIGS. 1 and 2. Thus, only the differences between the embodiments will be described further. A screw 115 may be disposed in the passage 45 formed in the shaft 40 and within the internal diameter of the spring (refer to FIG. 2 for internal detail of shaft 40). The head 115*a* of screw 115 may be disposed in the cavity 112 of the interface housing 111 and engaged or coupled with the track 114. Unlike the embodiment described above, the head 115*a* of the screw 115 is not coupled with a dowel nut.

Tightening the first adjustment nut 46*a* may compress the head 115*a* of the screw 115 against the track 114 and may reduce any clearance between the flange 44 of the shaft 40 and the interface housing 111. When there is little or no clearance between the flange 44 of the shaft 40 and the interface housing 111, the shaft 40 and the interface housing 111 may be attached, locked, or fixed together.

Loosening the first adjustment nut 46*a* may release the head 115*a* of the screw 115 from the track 114, which may create a gap between the shaft 40 and the interface housing 111 of the sight ring 90. With a sufficient gap, the shaft 40 and the sight ring 90 may be displaced relative to one another.

Figure 9:
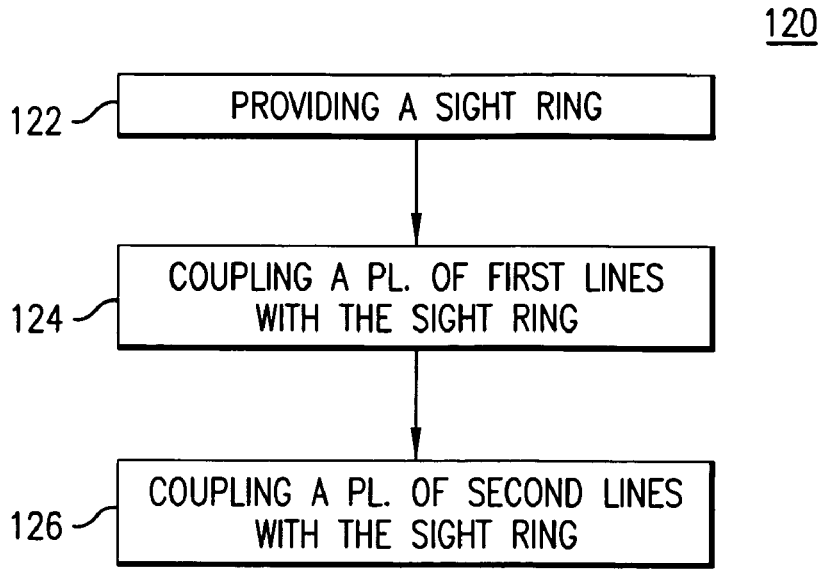
FIG. 9 shows a block diagram of a method according to an embodiment of the present invention.

Referring now to FIG. 9, a method 120 according to an embodiment of the invention is shown. The method 120 may be employed to make a sight, as described above. However, the method 120 may be used to make a wide variety of other sights. Items shown in FIGS. 1-8 may be referred to in describing FIG. 9 to aid understanding of the method 120.

As indicated by block 122, the method 120 may comprise providing a sight ring. As described above, the sight ring may comprise a proximal end and a distal end. As indicated by block 124, the method 120 may comprise providing a plurality of first lines with the proximal end of the sight ring. As indicated by block 126, the method 120 may comprise coupling a plurality of second lines with the proximal end of the sight ring. The plurality of first and second lines may be arranged in an alternating pattern. In one embodiment, the method 120 may comprise coupling the sight ring with an archery bow. In another embodiment, the method 120 may comprise coupling the sight ring with a firearm.

The plurality of first and second lines may extend radially from a center of the sight ring. The plurality of first and second lines may be formed in the proximal end of the sight ring. For example, the plurality of first and second lines may be etched into the proximal end of the sight ring.

In one embodiment, each one of the plurality of first lines may comprise a first color and each one of the plurality of second lines may comprise a second color. The second color may be complementary to the first color. The plurality of first lines may comprise a white line and the plurality of second lines may comprise a black line.

The sight ring may be adapted to support and/or house an aiming pin. In one embodiment, the aiming pin may be fixed to the sight ring. In another embodiment, the aiming pin may be removably engaged with the sight ring. A fiber optic filament may be coupled with the aiming pin.

The aiming pin may comprise a plurality of aiming pins. Each one of the aiming pins may be adapted to be adjusted manually, i.e., by hand without the use of tools. Each one of the plurality of aiming pins may be operable to be displaced independently of the other aiming pins.

In one embodiment, the method 120 further may comprise providing a shaft and providing a linkage adapted to be coupled with the shaft and an archery bow. The shaft may comprise a first end, a second end opposite the first end, and a body disposed between the first and second ends of the shaft. The first end of the shaft may be removably coupled with a track of the sight ring. The shaft may be adapted to be displaced along the track of the sight ring. Other suitable configurations can be used.

Figure 10:
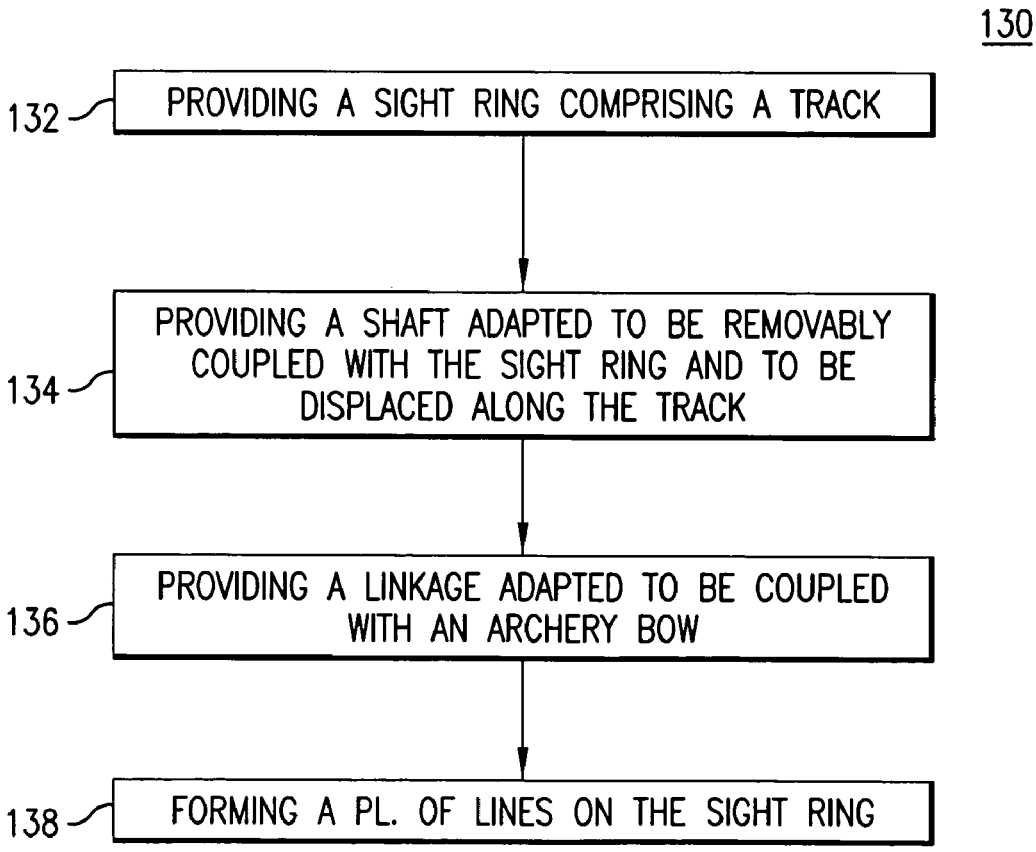
FIG. 10 shows a block diagram of a method according to another embodiment of the present invention.

Referring now to FIG. 10, a method 130 according to another embodiment of the invention is shown. The method 130 may be employed to make a sight, as described above. However, the method 130 may be used to make a wide variety of other sights. Items shown in FIGS. 1-8 may be referred to in describing FIG. 10 to aid understanding of the method 130.

As indicated by block 132, the method 130 may comprise providing a sight ring. The sight ring may comprise a proximal end, a distal end, and a track. The method may comprise coupling the sight ring with an archery bow. As indicated by block 138, the method 130 further may comprise coupling a plurality of first lines with the proximal end of the sight ring, and coupling a plurality of second lines with the sight ring. The plurality of first and second lines may be formed in the proximal end of the sight ring. The plurality of first and second lines may extend radially from a center of the sight ring and may be arranged in an alternating pattern about the sight ring.

Each of the plurality of first lines may comprise a first color and each of the plurality of second lines may comprise a second color. The second color may be complementary to the first color. The plurality of first lines may comprise a white line and the plurality of second lines may comprise a black line.

In one embodiment, the method may comprise providing an aiming pin housed by the sight ring. A fiber optic filament may be disposed in communication with the aiming pin. The aiming pin may comprise a plurality of aiming pins. Each one of the aiming pins may be operable to be displaced independently of the other aiming pins and may be adapted to be adjusted manually, i.e., by hand without the use of tools.

As indicated by block 134, the method 130 may comprise providing a shaft comprising a first end, a second end opposite the first end, and a body disposed between the first and second ends of the shaft. The first end of the shaft may be adapted to be removably coupled with the sight ring and to be displaced along the track.

As indicated by block 136, the method 130 further may comprise providing a linkage adapted to be coupled with an archery bow. The linkage may comprise an orifice forming a complementary surface with the body of the shaft. The linkage and the shaft may be adapted to be displaced relative to one another.

The linkage may comprise a first leg, a second leg, and an intermediate section joining the first and second legs. The first and second legs may be offset from and parallel to one another. The intermediate section may be disposed in an angular orientation with respect to the first and second legs. In one embodiment, the intermediate section may be disposed at about a 45 degree angle from the first leg. Other suitable configurations can be used.

Figure 11:
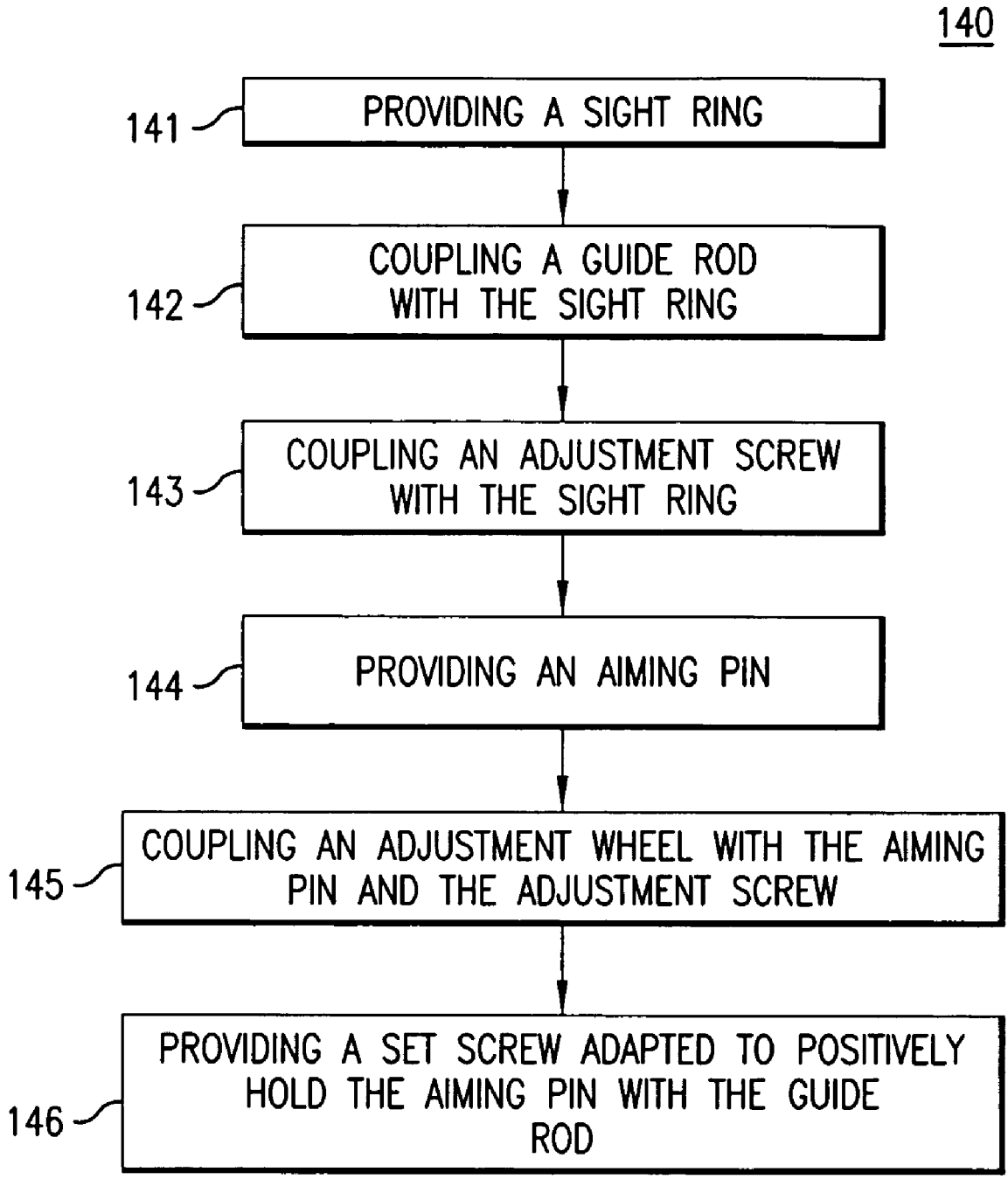
FIG. 11 shows a block diagram of a method according to still another embodiment of the present invention.

Referring now to FIG. 11, a method 140 according to another embodiment of the invention is shown. The method 140 may be employed to make a sight, as described above. However, the method 140 may be used to make a wide variety of other sights. Items shown in FIGS. 1-8 may be referred to in describing FIG. 11 to aid understanding of the method 140.

As indicated by block 141, the method 140 may comprise providing a sight ring defining an orifice. The sight ring may be similar to that described above. Alternatively, other suitable sight rings may be used. As indicated by block 142, the method 140 may comprise coupling a guide rod with the sight ring. The guide rod may comprise a major axis disposed substantially parallel with a vertical axis of the sight ring.

As indicated by block 143, the method 140 may comprise coupling an adjustment screw with the sight ring. The adjustment screw may be disposed substantially parallel with the guide rod.

As indicated by block 144, the method 140 may comprise providing an aiming pin. In one embodiment, the aiming pin may comprise a plurality of aiming pins. The aiming pin may comprise a first end and a second end opposite the first end. The first end of the aiming pin may be disposed in the orifice defined by the sight ring. The second end of the aiming pin may be coupled with the guide rod and the adjustment screw. The second end of the aiming pin may be slidably coupled with the guide rod and adjustably coupled with the adjustment screw.

As indicated by block 145, the method 140 may comprise coupling an adjustment wheel with the second aiming pin and the adjustment screw. The adjustment wheel may be adapted to displace the aiming pin along the guide rod and the adjustment screw. The adjustment wheel may be threadably engaged with the adjustment screw.

As indicated by block 146, the method 140 may comprise providing a set screw adapted to positively hold the aiming pin with the guide rod. In one embodiment, each one of the plurality of aiming pins may be adapted to be adjusted manually. In another embodiment, each one of the aiming pins may be operable to be displaced independently of the other aiming pins. The manipulation and operation of such a sight ring may be similar as that described above and with further reference to FIGS. 5-8.

While the present invention has been disclosed with reference to certain embodiments, numerous modifications, alterations, and changes to the described embodiments are possible without departing from the sphere and scope of the present invention, as defined by the appended claims. Accordingly, it is intended that the present invention not be limited to the described embodiments, but that it has the full scope defined by the language of the following claims, and equivalents thereof.

What is claimed is:

1. An apparatus comprising:

a sight ring for an archery product or firearm comprising a proximal end and a distal end, the sight ring attachable to an aimed device and arranged with the user viewing the target through the sight ring when the aimed device is oriented toward the target;

an aiming pin with a proximal end attached to the sight ring and extending to a distal end defining an aiming point;

a plurality of first lines arranged in a circular pattern on the proximal end of the sight ring; and a plurality of second lines arranged in a circular pattern on the proximal end of the sight ring, the plurality of first and second lines arranged in an alternating pattern about the sight ring.

2. The apparatus of claim 1, wherein the plurality of first and second lines extend radially from a center of the sight ring.

3. The apparatus of claim 1, wherein each one of the plurality of first lines comprises a first color and each one of the plurality of second lines comprises a second color, the second color complementary to the first color.

4. The apparatus of claim 1, wherein each one of the plurality of first lines comprises a white line and each one of the plurality of second lines comprises a black line.

5. The apparatus of claim 1, wherein the plurality of first and second lines are etched in the proximal end of the sight ring.

6. The apparatus of claim 1, wherein the aiming pin comprises a plurality of aiming pins.

7. The apparatus of claim 6, wherein each one of the plurality of aiming pins is adapted to be adjusted manually.

8. The apparatus of claim 6, wherein each one of the plurality of aiming pins is operable to be displaced independently of the other aiming pins.

9. The apparatus of claim 1, further comprising a fiber optic filament coupled with the aiming pin.

10. The apparatus of claim 1, wherein the sight ring is coupled with a firearm.

11. The apparatus of claim 1, wherein the sight ring is coupled with an archery bow.

12. The apparatus of claim 1, wherein the aiming pin includes a middle portion with a length extending between the proximal and distal ends, and wherein the target environment is viewable adjacent to and along the length of the middle portion when the aimed device is aimed toward the target.

13. The apparatus of claim 1, wherein the aiming pin includes a middle portion with a length extending between the proximal and distal ends, and wherein the cross section of the middle portion perpendicular to the length is substantially constant along the length of the middle portion.

14. An apparatus comprising:

a sight ring for an aimed device comprising a proximal end, a distal end, and a track, the track defined in an interior cavity of the sight ring, wherein the track defines a major axis disposed substantially parallel with a vertical axis of the sight ring;

a shaft with a first end and a second end, the first end engaging the sight ring and the second end connectable to the aimed device; and a locking member with a first end and a second end, the first end received within the sight ring interior cavity and adapted to be displaced along the track of the sight ring, the second end engaged with the shaft, wherein the locking member selectively draws the sight ring into compression with the shaft, selectively inhibiting displacement of the locking member along the track.

15. The apparatus of claim 14, further comprising a linkage adapted to be coupled with an archery bow, the linkage comprising an orifice forming a complementary surface with the body of the shaft, the linkage and the shaft adapted to be displaced relative to one another.

16. The apparatus of claim 14, wherein the linkage comprises a first leg, a second leg, and an intermediate section joining the first and second legs, the first and second legs offset from and parallel to one another.

17. The apparatus of claim 16, wherein the intermediate section is disposed in an angular orientation.

18. The apparatus of claim 14, further comprising an aiming pin housed by the sight ring.

19. The apparatus of claim 18, wherein the aiming pin comprises a plurality of aiming pins.

20. The apparatus of claim 19, wherein each one of the plurality of aiming pins is adapted to be adjusted manually.

21. The apparatus of claim 20, wherein each one of the plurality of aiming pins is operable to be displaced independently of the other aiming pins.

22. The apparatus of claim 18, further comprising a fiber optic filament in communication with the aiming pin.

23. The apparatus of claim 14, wherein the sight ring is coupled with an archery bow.

24. The apparatus of claim 14, wherein the shaft is arranged perpendicular to the vertical axis of the sight ring.

25. The apparatus of claim 14, wherein the locking member first end is a dowel nut.

26. The apparatus of claim 14, wherein the locking member first end is selected from the group consisting of a screw head and a bolt head.

27. The apparatus of claim 14, wherein the sight ring is coupled with a firearm.

28. A sighting apparatus for an archery bow, comprising:

a sight ring adapted and configured for a user to view the target through the sight ring, the sight ring having an interface surface and a track, the track defined in an interior cavity of the sight ring and defining a major axis disposed substantially parallel with a vertical axis of the sight ring, the interior cavity having a side wall and a passageway to an exterior surface extending through the side wall, the passageway disposed perpendicular to the track; and a locking member attachable to the archery bow and extending from a sight mounting portion through the passageway and into the track, the locking member having a first end in the track configured to engage the sidewall, wherein the locking member is adjustable to selectively compress the sight ring interface surface against the sight mounting portion.

29. The sighing apparatus of claim 28, wherein the locking member first end is a dowel nut.

30. The sighing apparatus of claim 28, wherein the locking member first end is selected from the group consisting of a screw head and a bolt head.

31. An apparatus comprising:

a sight ring for an aimed device comprising a proximal end and a distal end, the sight ring attachable to the aimed device and arranged with the user viewing the target through the sight ring when the aimed device is oriented toward the target, and wherein the aimed device propels a projectile toward the target;

an aiming pin supported by the sight ring and extending to a distal end defining an aiming point;

a plurality of first lines extending radially from a center of the sight ring disposed on the proximal end of the sight ring; and a plurality of second lines extending radially from a center of the sight ring disposed on the proximal end of the sight ring, the plurality of first and second lines arranged in an alternating pattern about the sight ring.

32. The apparatus of claim 31, wherein the sigh ring is coupled with a firearm.

33. The apparatus of claim 31, wherein the sight ring is coupled with an archery bow.

34. The apparatus of claim 31, wherein the aiming pin includes a proximal end attached to the sight ring and a middle portion with a length extending between the proximal and distal ends, and wherein the target is viewable adjacent to and along the length of the middle portion when the aimed device is oriented toward the target.

35. The apparatus of claim 31, wherein the aiming pin includes a proximal end attached to the sight ring and a middle portion with a length extending between the proximal and distal ends, and wherein the cross section of the middle portion perpendicular to the length is substantially constant along the length of the middle portion.

* * * * *

UNITED STATES PATENT AND TRADEMARK OFFICE

CERTIFICATE OF CORRECTION

PATENT NO. : 7,308,891 B2
APPLICATION NO. : 10/985403
DATED : December 18, 2007
INVENTOR(S) : Stephen Charles Graf It is certified that error appears in the above-identified patent and that said Letters Patent is hereby corrected as shown below:

In column 15, line 8, please change "The apparatus of claim 14" to --The apparatus of claim 15--

In column 16, line 6, please change "The sighing apparatus" to --The sighting apparatus--

In column 16, line 8, please change "The sighing apparatus" to --The sighting apparatus--

In column 16, line 29, please change "wherein the sigh ring" to --wherein the sight ring--

Signed and Sealed this

Twentieth Day of May, 2008

JON W. DUDAS
*Director of the United States Patent and Trademark Office*